US008137769B1

(12) United States Patent
Copeland

(10) Patent No.: US 8,137,769 B1
(45) Date of Patent: Mar. 20, 2012

(54) LANDSCAPE CONCEALMENT STRUCTURE

(75) Inventor: Charles A. Copeland, Chesapeake City, MD (US)

(73) Assignee: RLP Management Holdings, LLC, Franklin Lakes, NJ (US)

( * ) Notice: Subject to any disclaimer, the term of this patent is extended or adjusted under 35 U.S.C. 154(b) by 283 days.

(21) Appl. No.: 12/392,427

(22) Filed: Feb. 25, 2009

(51) Int. Cl.
*A01N 3/00* (2006.01)

(52) U.S. Cl. ..... 428/18; 220/23.87

(58) Field of Classification Search ..... 135/87, 135/148, 157, 901; 43/1–3; 428/18; 220/23.87
See application file for complete search history.

(56) References Cited

U.S. PATENT DOCUMENTS

| | | | | | |
|---|---|---|---|---|---|
| 2,113,523 | A | * | 4/1938 | White | 47/33 |
| 3,034,844 | A | * | 5/1962 | Anderson et al. | 312/265.4 |
| 3,170,587 | A | * | 2/1965 | Beeber | 220/23.87 |
| 3,928,712 | A | * | 12/1975 | Sears | 174/38 |
| 4,323,605 | A | * | 4/1982 | Rush | 428/17 |
| 4,375,488 | A | * | 3/1983 | Hogan | 428/17 |
| 4,517,230 | A | * | 5/1985 | Crawford | 428/17 |
| 4,792,471 | A | | 12/1988 | Lee | |
| 5,221,565 | A | | 6/1993 | Johnson | |
| 5,377,711 | A | * | 1/1995 | Mueller | 135/87 |
| 5,611,176 | A | | 3/1997 | Juengert et al. | |
| 5,787,649 | A | | 8/1998 | Popowych et al. | |
| 5,989,656 | A | | 11/1999 | Soloman | |
| 6,117,503 | A | | 9/2000 | Lee et al. | |
| 6,122,866 | A | | 9/2000 | Thomas et al. | |
| 6,158,175 | A | * | 12/2000 | Carter | 52/79.5 |
| 6,286,266 | B1 | | 9/2001 | Popowych et al. | |
| 6,306,471 | B1 | | 10/2001 | Pitman et al. | |
| 6,343,440 | B1 | | 2/2002 | Ayers | |
| 6,658,797 | B2 | * | 12/2003 | Jones | 52/40 |
| 6,701,948 | B2 | * | 3/2004 | Jopp et al. | 135/97 |
| 7,051,839 | B1 | * | 5/2006 | George | 182/116 |
| 7,121,290 | B2 | * | 10/2006 | Eastman, II | 135/121 |
| 7,225,823 | B1 | * | 6/2007 | Ransom et al. | 135/126 |
| 7,371,442 | B2 | | 5/2008 | Pitman | |
| 7,565,909 | B2 | * | 7/2009 | Reis et al. | 135/115 |
| 7,650,899 | B2 | * | 1/2010 | Eastman et al. | 135/120.1 |
| 7,740,022 | B2 | * | 6/2010 | Li | 135/87 |
| 7,743,781 | B2 | * | 6/2010 | Slaughter | 135/117 |
| 7,819,151 | B1 | * | 10/2010 | Kuhn | 150/154 |
| 7,866,769 | B2 | * | 1/2011 | Ahlgrim et al. | 312/108 |
| 2002/0043038 | A1 | * | 4/2002 | Cerrato | 52/604 |
| 2002/0150700 | A1 | | 10/2002 | Tennie | |
| 2003/0107304 | A1 | * | 6/2003 | Chen et al. | 312/223.2 |
| 2004/0011346 | A1 | | 1/2004 | Sakai | |
| 2005/0166838 | A1 | * | 8/2005 | Smith | 118/326 |
| 2006/0096630 | A1 | | 5/2006 | Eastman et al. | |
| 2006/0165931 | A1 | * | 7/2006 | Gaulrapp et al. | 428/36.1 |
| 2006/0207641 | A1 | | 9/2006 | Reis et al. | |
| 2007/0234651 | A1 | * | 10/2007 | Gage | 52/173.2 |
| 2008/0074013 | A1 | * | 3/2008 | Ahlgrim et al. | 312/108 |
| 2008/0087388 | A1 | * | 4/2008 | Smith | 160/223 |
| 2009/0320390 | A1 | * | 12/2009 | Kolozsvari et al. | 52/202 |

* cited by examiner

*Primary Examiner* — Eileen D Lillis
*Assistant Examiner* — Alp Akbasli
(74) *Attorney, Agent, or Firm* — Rosenburg, Klein & Lee

(57) ABSTRACT

A landscape concealment structure (200) includes a housing (150) formed by shell (100) and a cover panel member (140) coupled to the shell and overlaying an enclosed space (126) into which a utility structure or mechanical device (20) is received to obscure such from view. The shell includes at least a pair of side panel members (120 and 130) coupled to a front panel member (110). The housing is camouflaged by a plurality of artificial foliage members (160) coupled to the housing to take on the appearance of a shrub, tree or other flora. The landscape concealment structure may further include a coupling assembly (180) that has a pivotal coupling (182) for facilitating rotative displacement of at least the shell relative to a base surface (30, 34).

17 Claims, 8 Drawing Sheets

LANDSCAPE CONCEALMENT STRUCTURE

BACKGROUND OF THE INVENTION

1. Field of the Invention

This invention directs itself to an aesthetically designed structure which blends with the surrounding landscape to conceal utility structures or mechanical devices from view. In particular, this invention directs itself to a concealment structure which includes a plurality of panel members joined together to form a housing which surrounds a space containing a utility structure or mechanical device. Further, this invention directs itself to a landscape concealment structure wherein a front panel member having ventilation openings is joined to a pair of side panel members having ventilation openings to form a shell to which a cover panel member having ventilation openings is releasably coupled to form a housing, and to which are coupled a plurality of artificial foliage members that camouflage the housing so that it blends in with the local landscape.

2. Prior Art

Landscape concealment structures are known in the art. Often, fencing or walled-in areas are utilized to conceal utility structures and mechanical devices, which structures are permanent and high cost, and rarely blend in with the surrounding landscape.

In other prior art systems a netting material is utilized to overlay the utility structure or mechanical device and artificial foliage is coupled to the netting in order to camouflage the overlaid device. Here, the utility structure or mechanical equipment provides the structural support for the netting while the netting provides the means for securing the artificial foliage in place. The amount of artificial foliage which may be coupled to the netting is limited, so as not to restrict air flow to the device. As there is no air space provided between the netting and the utility structure or mechanical device being camouflaged, the amount of open space between artificial foliage members is critical to the ventilation of the covered structure or device. Thus, it is not always possible to provide adequate camouflage with the artificial foliage in such close proximity to the covered device, separated by only the netting, due to the ventilation requirements of the device.

In still other prior art camouflage enclosures the flaccid cover is reinforced with a flexible webbing frame so that the cover maintains a predetermined shape. However, such systems still rely on the structure being overlaid for structural support of the camouflage cover. Such covers, rather than being formed of netting, have a more tightly woven material and have natural-effect strands oriented vertically therein to give a camouflage appearance. The natural-effect strands may be augmented with a plurality of artificial leaves that are attached by stitching. Here again, as the structure being covered provides structural support, and the limited ventilation provided by such structures greatly inhibits their use with equipment that must dissipate a substantial amount of heat or requires a substantial amount of gas exchange.

The invention of the subject patent application overcomes the problems of the prior art by providing a self-supporting structure which is aesthetically designed and can be strategically located to conceal utility structures or mechanical devices from view while still providing access to the concealed devices and providing the required/appropriate ventilation.

SUMMARY OF THE INVENTION

A landscape concealment structure for obscuring a utility structure or mechanical device from view includes a front panel member and a pair of side panel members respectively coupled to the front panel member, adjacent opposing sides thereof, to form a shell. The shell substantially surrounds a space containing an object to be concealed. The landscape concealment structure further includes a cover panel member coupled to the shell and overlaying the space to form a housing, and a plurality of artificial foliage members coupled to the housing to camouflage the housing.

From another aspect, the landscape concealment structure for obscuring a utility structure or mechanical device includes a front panel member having a plurality of ventilation openings formed therein and a pair of side panel members respectively coupled to the front panel member, adjacent opposing sides thereof, to form a shell. Each of the side panel members has a plurality of ventilation openings formed therein. The shell substantially surrounds a space containing an object to be concealed. The landscape concealment structure further includes a cover panel member coupled to the shell and overlaying the space to form a housing. The cover panel member has a plurality of ventilation openings formed therein.

From yet another aspect, the landscape concealment structure for obscuring a utility structure or mechanical device from view includes a front panel member having a plurality of louvered openings formed therein, and a pair of side panel members respectively coupled to the front panel member adjacent opposing sides thereof to form a shell. Each of the side panel members has a plurality of louvered openings formed therein. The shell substantially surrounds a space containing an object to be concealed. The landscape concealment structure also includes a cover panel member releasably coupled to the shell and overlaying the space to form a housing. The cover panel member has a plurality of louvered openings formed therein. The landscape concealment structure further includes a plurality of artificial foliage members coupled to the housing to camouflage the housing, and a coupling assembly coupled to the shell for securing the shell to a base surface. The coupling assembly includes a pivotal coupling for rotatively displacing at least the shell relative to the base surface to expose the object.

DESCRIPTION OF THE PREFERRED EMBODIMENTS

Figure 1:
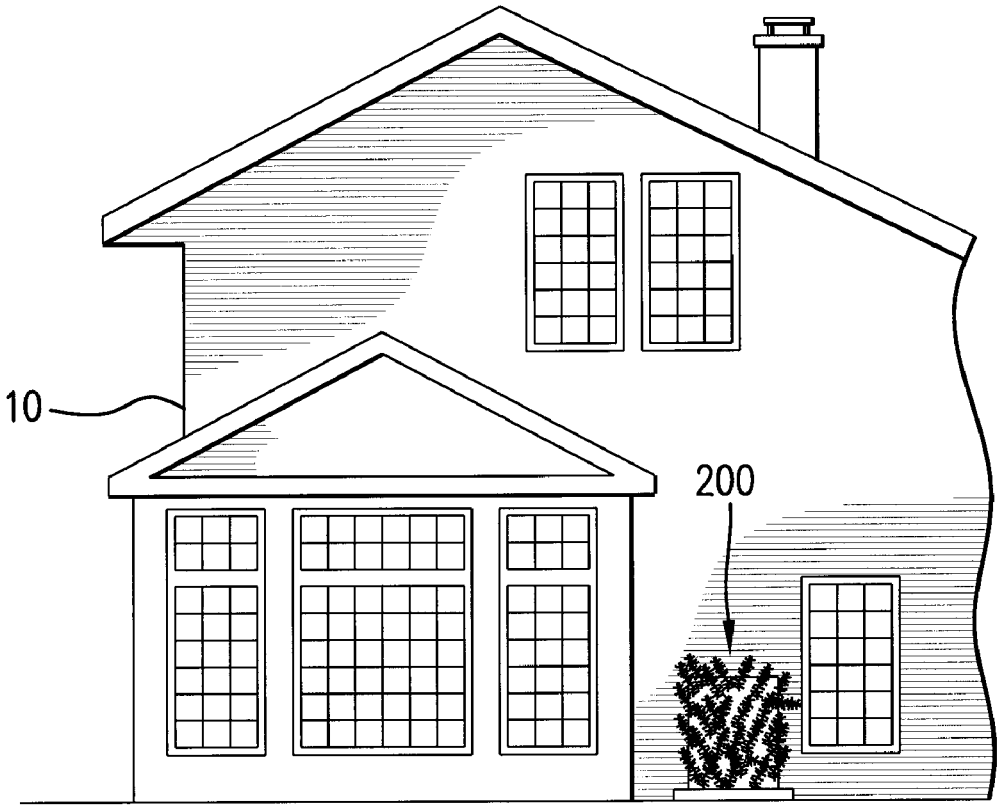
FIG. 1 is an elevation view illustrating the use of the present invention.

Referring to FIGS. 1-11, there is shown landscape concealment structure 200 for obscuring utility structures or mechanical devices 20 from view. As will be seen in following paragraphs, landscape concealment structure 200 is specifically directed to the concept of providing an aesthetically designed structure which may be strategically located to camouflage unsightly outdoor facilities such as utility meters; utility devices such as transformers, telephone/cable amplifiers, connection boxes and the like; as well as mechanical devices such as pumps, air conditioning devices, water filtration devices; and other equipment such as that which is used for pools, ponds, wells and sanitary systems. Landscape concealment structure 200 has application for use on residential, commercial and public properties; however, landscape concealment structure 200 is particularly adapted for use in obscuring those utility structures or mechanical devices typically found adjacent to residential building 10, since it presents an aesthetically pleasing appearance, no obstruction to the operation of the utility structure or mechanical device and provides an unobstructed access to the equipment being concealed.

Landscape concealment structure 200 additionally provides a visually attractive system in the form of a housing 150 which in itself can blend in with the appearance of an adjacent structure 10 or can be camouflaged with the use of a plurality of artificial foliage members 160 that may be coupled to the housing 150. Unlike structures that are constructed in-place to conceal utility structures or mechanical devices, landscape concealment structure 200 provides a structure that provides for releasable coupling of a plurality of prefabricated panel members 110, 120, 130, 140 (and optionally 115). The prefabricated panel members 110, 115, 120, 130, 140 are formed with a plurality of ventilation openings 124 provided in corresponding louvers 122, and all are adapted for having a plurality of artificial foliage members 160 being coupled thereto.

Figure 2:
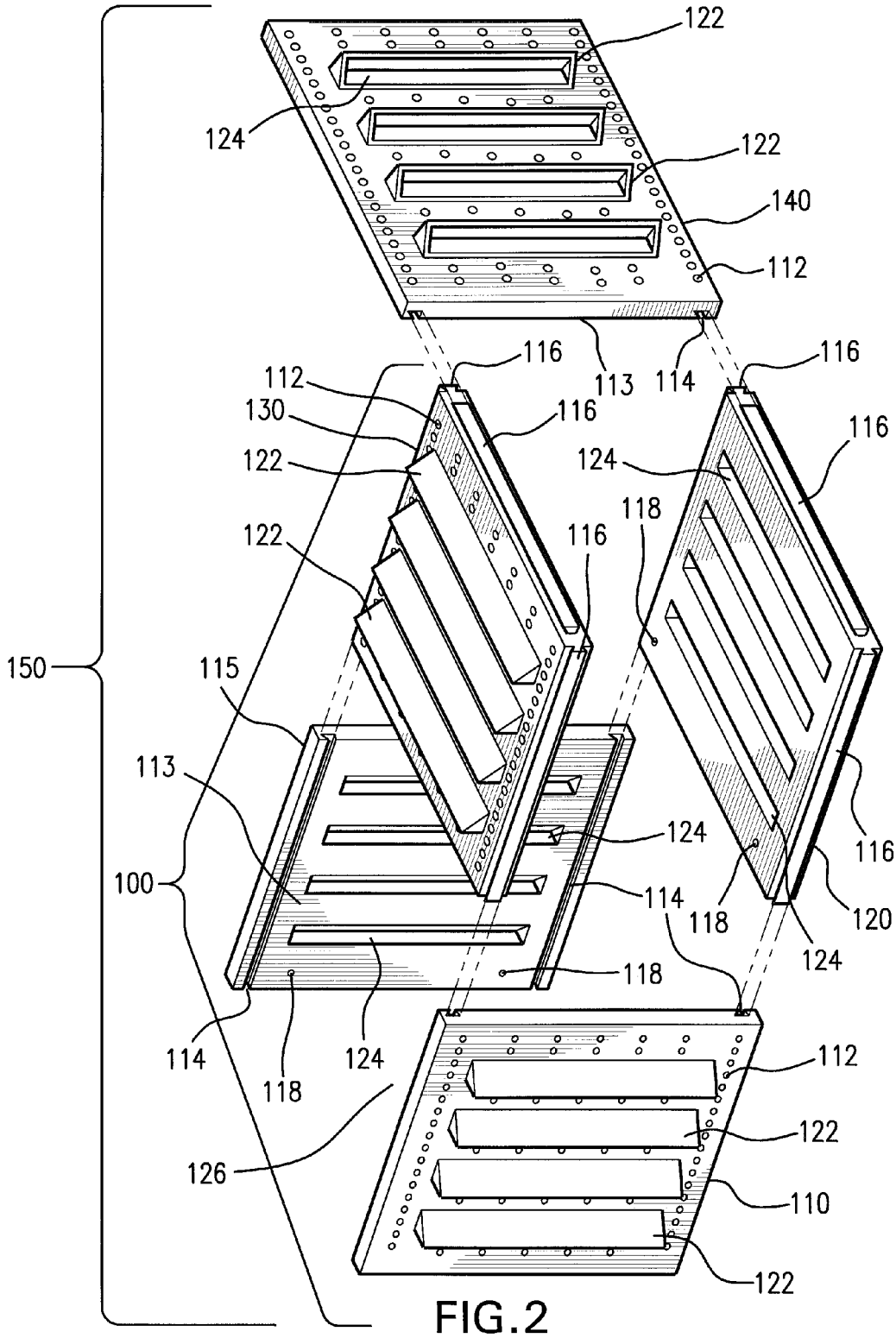
FIG. 2 is an exploded perspective view of the housing portion of the present invention.
Figure 3:
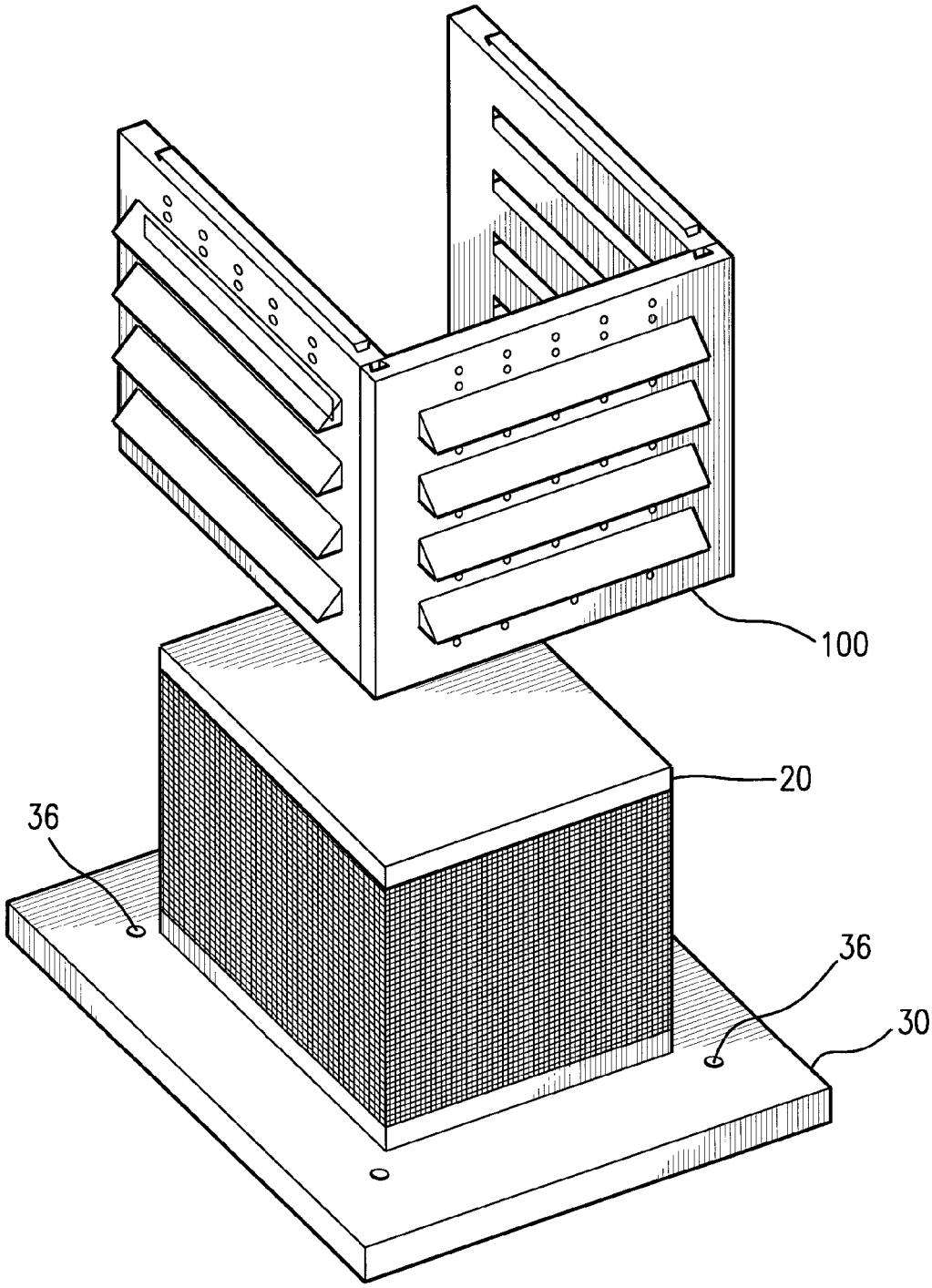
FIG. 3 is an exploded perspective view illustrating use of the shell portion of the present invention.
Figure 4:
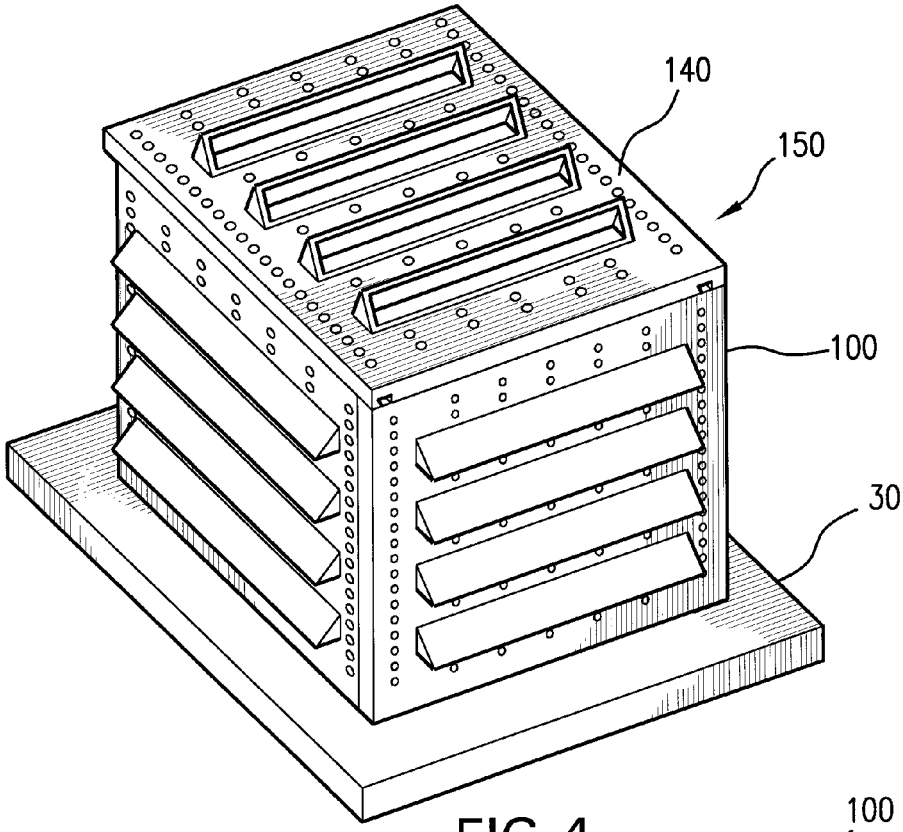
FIG. 4 is a perspective view illustrating use of the housing portion of the present invention.

Referring now to FIGS. 2-4, housing 150 includes at least a shell 100 and a cover panel member 140. Shell 100 includes at least a front panel member 110 and at least a pair of side panel members 120 and 130. Optionally, shell 100 may also include a rear panel member 115. Most applications for use of the concealment structure 200 will utilize a shell formed by front panel member 110 and the two side panel members 120 and 130, to which the cover panel member 140 will be coupled. For those applications, the structure or device being concealed is typically located close to a building structure 10 and thus there is no loss of aesthetics utilizing a shell formed of only three sides. However, for those applications which are more remote from the building 10, an optional rear panel member 115 may be added to housing 150 by joining rear panel member 115 to the pair of side panel members 120 and 130 to provide an aesthetically pleasing enclosure from any viewpoint.

As many utility structures and mechanical devices 20 require exposure to the ambient atmosphere in order to dissipate heat or provide a source of fresh air, housing 150 is provided with a plurality of ventilation openings 124. Thus, the front panel member 110, the side panel members 120 and 130, the optional rear panel member 115 and the cover panel member 140 are each provided with a plurality of louvers 122, each louver having a ventilation opening 124 formed therethrough. The louvers 122 shield the ventilation openings 124 from some degree of ingress of precipitation, while allowing for a free flow of air in and out of the space 126 enclosed by the housing 150. The front panel member 110, the side panel members 120 and 130, the optional rear panel member 115 and the cover panel member 140 of housing 150 further include a plurality of openings 112 formed therein for use in coupling respective artificial foliage members 160 therein, in order to camouflage the housing 150 and give the appearance of a shrubbery, tree or other aesthetically pleasing flora. Each of the front panel member 110, the side panel members 120 and 130 and the optional rear panel member 115 include a plurality of fastening apertures 118 formed therein. While apertures 118 are depicted as only being disposed adjacent a bottom edge of the respective panel members, it should be understood that the openings may also be formed adjacent both top and bottom edges so that the panels may be used in an inverted orientation where it is desired to allow for ingress of precipitation and moisture, and/or for use in securing the panel members together.

The panel members 110, 120 and 130, and optionally panel member 115, which form shell 100, the cover panel member 140 which is joined thereto to form the housing 150, may be formed of various materials. The material from which the panel members are formed may be natural, synthetic or composites thereof. The structure of housing 150 is particularly adapted to use of panel members that are formed of polymeric materials, which may be virgin, recycled or mixtures thereof. Such panel member may be manufactured using casting, lay up techniques or injection molding. Panel members 110, 120 and 130, and optional rear panel member 115 may be coupled together and subsequently joined to the cover panel member 140 to form housing 150 utilizing commercially available fastening devices or adhesives, as is conventional. However, where panel members 110, 120, 130, 115 and 140 are formed of plastic material compositions, they may be formed with an integral coupling structure defined by complimentary mortise and tenons to provide a quick and secure means of coupling that may be employed at the location where the landscape concealment structure 200 is to be utilized. Thus, front panel member 110, as well as the optional rear panel member 115, is formed with a pair of receiving grooves 114 formed in an inner surface 113 thereof adjacent opposing side edges of the panel. Each of the receiving grooves 114 extends substantially for the full height of the respective panel member and has a cross-sectional contour that defines a dovetail shaped mortise, well known in the art. The grooves 114 may be open at both ends, or closed at one end to act as a stop for the mating tenon. Likewise, top cover 140 includes a pair of receiving grooves 114 formed in the inner side 113 thereof, adjacent opposing side edges of the top cover panel. The receiving grooves 114 of cover panel member 140 also have a respective cross-sectional contour that defines a dovetail shaped mortise extending longitudinally for substantially the extent of the panel member. Side panel members 120 and 130 have elongated tenons 116 formed on at least two adjacent edges thereof for respective engagement with the front panel member 110 and cover panel member 140. Each of the elongated tenons 116 have a dovetail shape which is complimentary to that of the respective mortises defined by the receiving grooves 114 of the front panel member 110 and cover panel member 140, in order to provide the respective engagement therewith. Side panel members 120 and 130 may further include elongated tenons 116 on their respective rear edges in order to provide engagement with a rear panel member 115, which optionally may be employed. Side panel members 120 and 130 may further respectively include elongated tenons on a bottom edge to allow for inversion of the side panel members to provide a reverse orientation of the louvers 122. Alternately, the side panel members 120 and 130 may respectively include receiving grooves 114 on the bottom edge to allow for a stacking arrangement of the panel members. Where the housing is formed by stacked panel members, the front panel member 110 and optional rear panel member 115 are formed with receiving grooves 114 on the top edge and tenons 116 on the bottom edge.

For most application, the mortise and tenon coupling between the panel members will be sufficient to provide a stable structure without the use of further fasteners or adhesive, thus making the structure easily disassembleable. For other situations, securement between the panels may be further enhanced by the addition of threaded fasteners or adhesives, and openings and corresponding fastening apertures may be formed in the panel members for that purpose.

Figure 10:
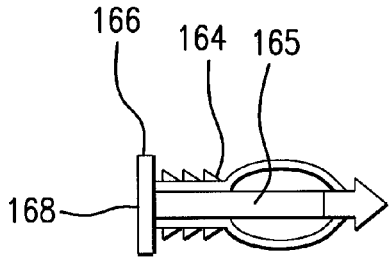
FIG. 10 is a plan view of a foliage locking insert of the present invention; and, FIG. 11 is a perspective view illustrating use of the present invention.
Figure 9:
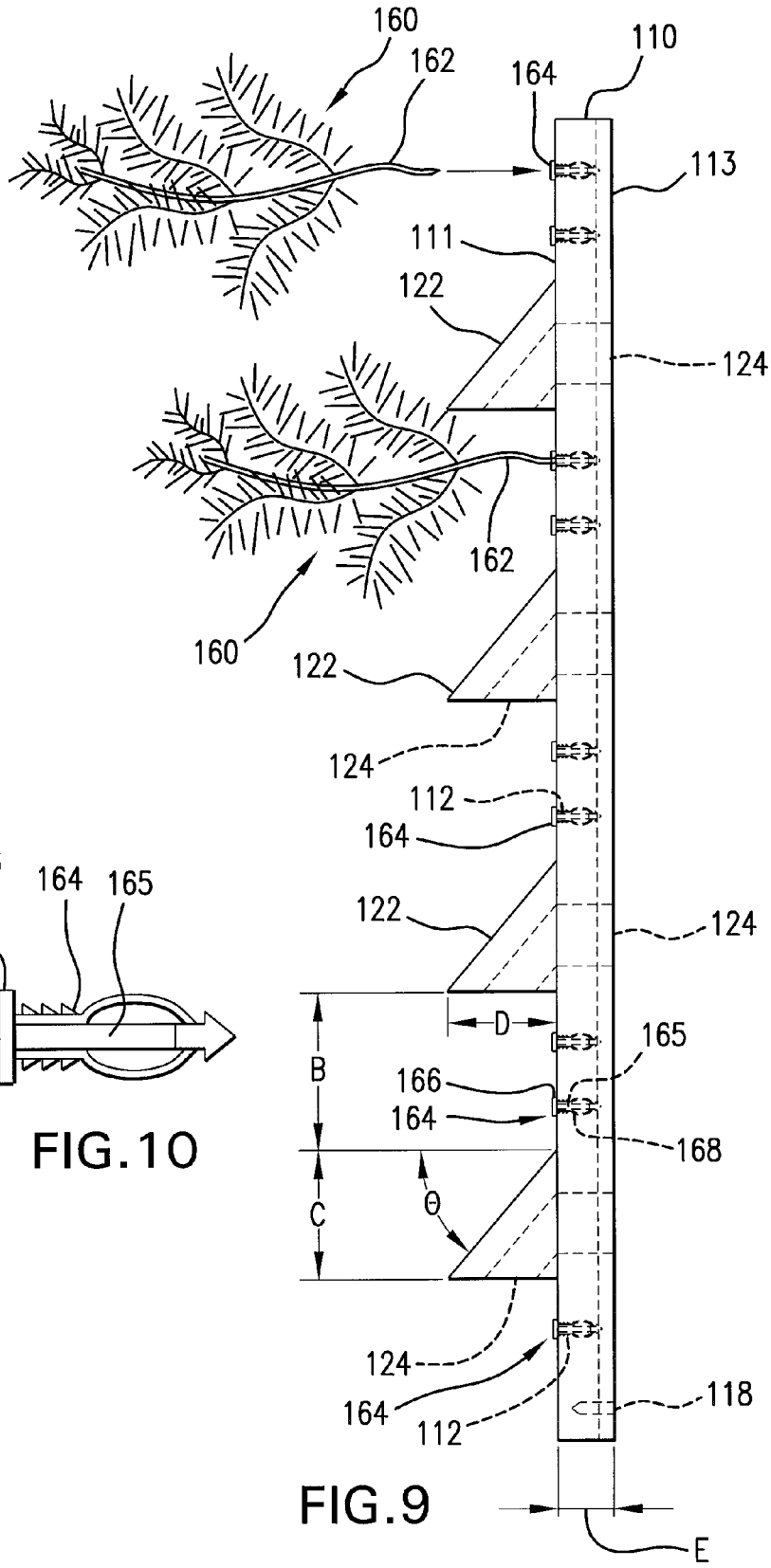
FIG. 9 is an elevational side view of a panel member of the present invention illustrating coupling of artificial foliage members thereto.
Figure 11:
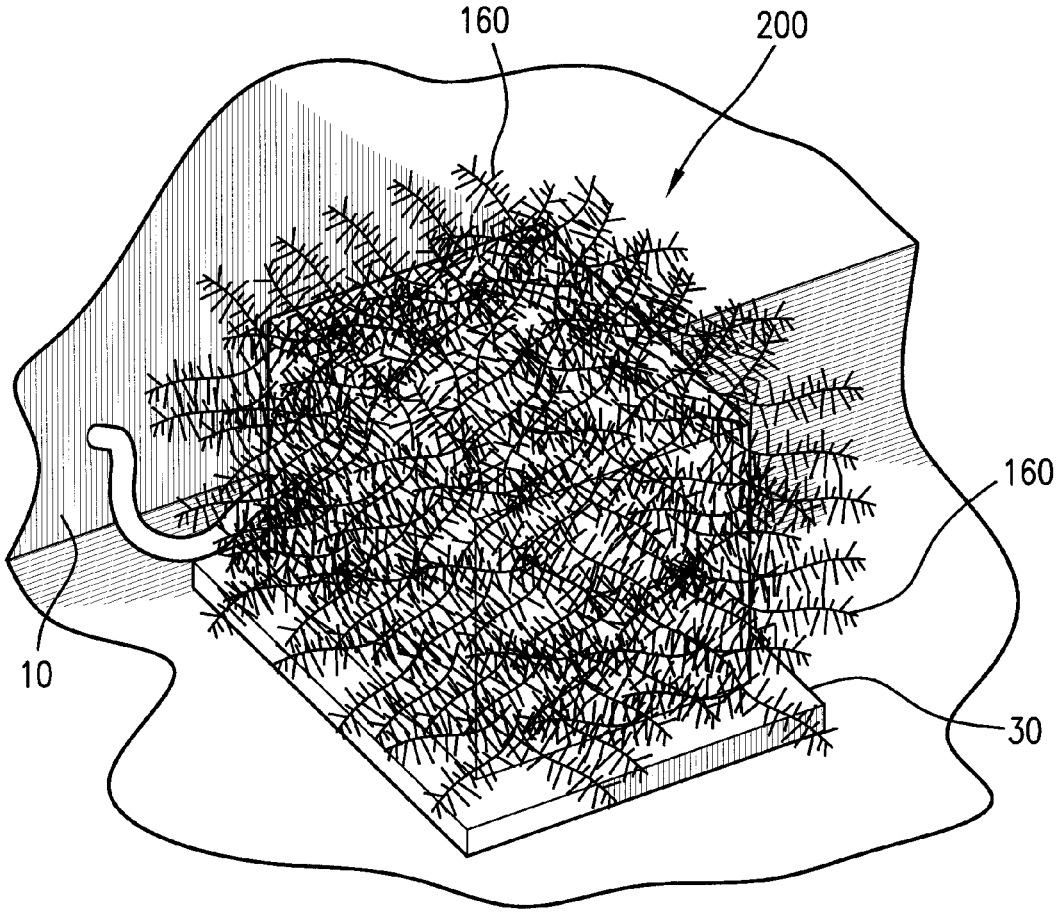

In a typical use, shell 100 is assembled by joining the side panel members 120 and 130 to front panel member 110, and then shell 100 is positioned to be disposed around the utility structure or mechanical device 20 to be concealed. While the device being concealed is depicted in the drawings as an air conditioning condenser unit, it is understood that any device or structure which disrupts the aesthetics of the surrounding area may be concealed by landscape concealment structure 200. Such devices may include utility meters or equipment, pumps, holding tanks, ground mounted antennas, access to subterranean piping or enclosures, etc. Shell 100 is positioned to surround the device 20 and secured to the base surface 30, such as through utilization of the fastening apertures 36 formed in the base surface 30. Base surface 30 may be an existing supporting surface located at the site, or a base panel member 38 provided as part of landscape concealment structure 200. After shell 100 is secured to the base surface 30, by means to be described in following paragraphs, the cover member 140 is then coupled to the shell 100 to form the housing 150. Housing 150 can be formed with a surface texture and coloring to resemble various natural woods or other materials which match or complement the surrounding architectures to be sufficiently aesthetically pleasing without the need to camouflage the housing any further.

Where the coloring and faux finishing of the housing surface is insufficient to provide the necessary aesthetics of the landscape, landscape concealment structure 200 provides for the coupling of a plurality of artificial foliage members 160 to housing 150 as shown in FIG. 11. As previously described, each of the panel members 110, 120, 130, 140 and optional panel member 115 are provided with a plurality of openings 112 for coupling with respective artificial foliage members 160. The openings 112 may be internally threaded or dimensioned for an interference fit with a respective complimentary portion of the artificial foliage members 160. As a means of simplifying the manufacture of the respective panel members, the openings 112 may be dimensioned to respectively receive a locking insert for coupling the artificial foliage member. Referring additionally to FIGS. 9 and 10, panel member 110 is shown, and is intended to be representative of each of the other panel members 115, 120, 130 and 140 with respect to the common elements thereof. For each opening 112 receiving an artificial foliage member 160, a foliage locking insert 164 is inserted into the respective opening 112. The foliage locking insert 164 includes an elongated body portion 165 which extends from an outer flange portion 166. The foliage locking insert 164 has an axially extended receiving bore 168 formed therein having elastically displaceable sidewall portions internal to the receiving bore 168 for providing a releasable locking engagement with a supporting shaft 162 of a corresponding artificial foliage member 160. Each artificial foliage member 160 is provided with a supporting shaft simulating a stem of the foliage, and having a distal end adapted for engagement within the receiving bore 168 of a corresponding foliage locking insert 164, or alternately, directly with the corresponding opening 112 of the panel member. Foliage locking insert 164 may further include barbs and/or elastically displaceable outer wall portions for engagement with an inner surface of the opening 112. One commercially available device that functions as the foliage locking insert 164 is a plastic anchor device available from Cobra Anchor Corporation of Temple, Pa. and having a designation Triple Grip Multipurpose Anchor.

Thus, if the openings 112 of the panel members are internally threaded, the distal ends of the supporting shafts 162 would correspondingly have an external thread complimentary thereto. Alternately, if the engagement between the openings 112 and supporting shafts 162 are intended to be frictional, the distal ends of the shafts 162 would be appropriately dimensioned for an interference fit within the opening 112. Artificial foliage members 160 are commercially available and are provided in various sizes, with varying lengths of supporting shafts 162, so that the camouflaged housing would have the appearance of a well trimmed shrubbery, tree or other flora appropriate to the landscape.

As previously discussed, each of panel members 110, 115, 120, 130 and 140 may be formed of a plastic material composition, which may include composites formed with recycled materials. Each of the panels may have a thickness dimension E in a range of 0.5-2 inches thick, which thickness may depend on the structural requirements for housing 150, based on the size requirements of housing 150 to appropriately enclose a particular utility structure or mechanical device. Each louver 122 extends at an angle θ which is within the range of 25°-75° and preferably within the range of 30°-60°. Each louver 122 extends outwardly from the outer surface 111 a dimension D, which is within the range of 2-4 inches, and extends longitudinally a dimension C that is within the range of 3-5 inches. Each of the louvers 122 are longitudinally spaced from an adjacent louver 122 a dimension B, which is within the range of 4-6 inches. It should be understood that each of the aforesaid dimensional ranges are typical dimensions, and that the actual dimensions for a particular installation may be outside those ranges based on the structural and/or air flow requirements for that installation.

Figure 5:
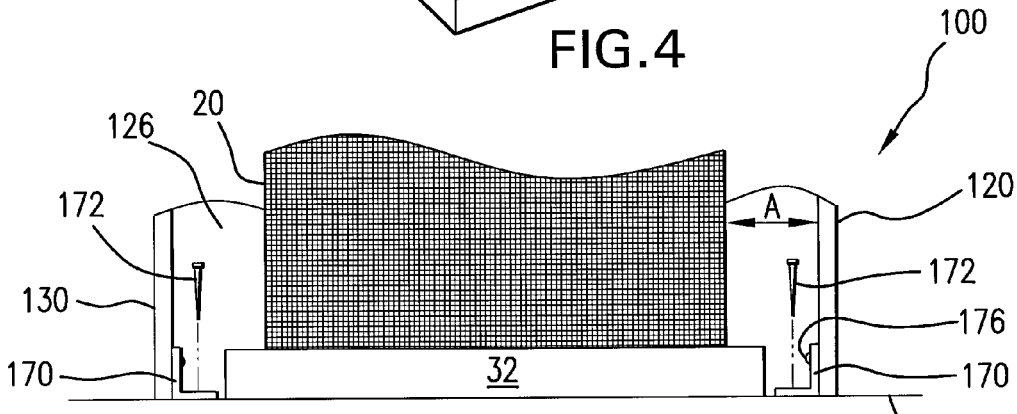
FIG. 5 is a rear cutaway elevational view showing securement of the present invention.
Figure 7:
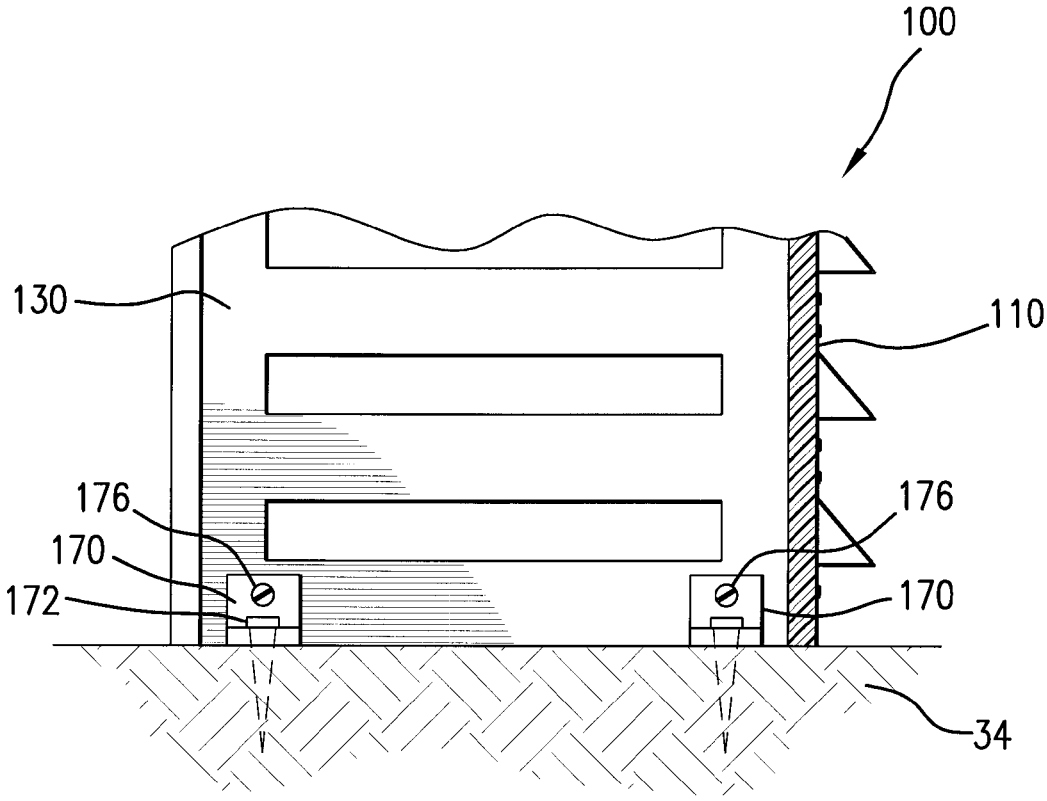
FIG. 7 is a cutaway cross-sectional view of the securement shown in FIG. 5.

Referring now to FIGS. 5 and 7, there is shown one of the methods by which the shell 100 is secured to a base surface which is defined by an earthen surface 34. Many utility structures and mechanical devices 20 are mounted to base surfaces other than an earthen surface. Such support surfaces, such as the air conditioning pad 32, are preexisting and likely of insufficient lateral dimension to secure shell 100 thereto while maintaining the desired air spacing A between the device 20 and the panel members of housing 100. The spacing dimension A is maintained between the panel members 110, 115, 120, 130 of shell 100 and the device 20, as well as between the cover panel member 140 and the device 20. The values for the spacing dimension A given in following paragraphs applies hereto. In other circumstances, utility devices such as utility meters are not usually supported by any structure extending to the ground 34. For these applications, a plurality of bracket members 170, each having an L-shaped contour, are used. Each of the two legs of the bracket members 170 have at least one through opening formed therein. Bracket members 170 are secured to the side panel member 120 and 130 by means of threaded fasteners 176 passed through corresponding through openings of respective legs of the bracket members 170 and are engaged with corresponding fastening apertures 118 formed in the respective panel members. Alternately, and/or additionally, L-shaped bracket members 170 may be coupled to the front panel member 110 using the fastening apertures 118 formed therein. The fastening apertures 118 may be internally threaded, provided with threaded inserts, or formed with appropriately dimensioned bores for being engaged by the threaded fasteners 176.

As the earthen ground surface 34 serves as the base surface to which the shell 100 is being secured, stake members 172 are used to respectively fasten the free legs of bracket members 170 to the ground surface 34. Each stake member 172 passes through an opening formed in the leg of the bracket members 170 for penetration into the earthen surface 34. Stake members 172 may be in the form of substantially smooth elongated spikes, or formed with longitudinally extended flutes, barbs or threaded portions to enhance the engagement with the earthen surface 34. Once shell 100 is secured to the surface 34, the cover member 140 may then be engaged therewith followed by the installation of the artificial foliage members 160 if the housing 150 is to be camouflaged.

Figure 6:
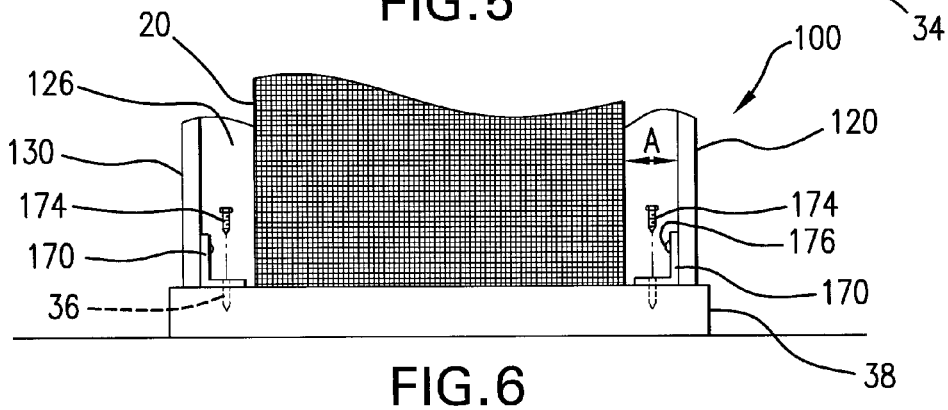
FIG. 6 is a rear cutaway elevational view showing an alternate securement of the present invention.

In new installations, wherein use of landscape concealment structure 200 is planned, the base surface to which the shell 100 is secured may be included as part of the landscape concealment structure 200. Referring now to FIG. 6, base panel member 38 is designed to mount both the device 20 in accordance with the specifications for that device, and the housing 150 appropriately spaced from the device 20. Base panel member 38 may be formed from a wide variety of materials, including the same materials from which the panel members 110, 115, 120, 130 and 140. Base surface 38 is provided with fastening apertures 36 for securement of the shell 100 thereto, the fastening apertures 36 being located so that the required spacing dimension A between the device structure or mechanical device 20 and the panel members of shell 100 can be maintained. The clearance dimension A between the shell and a residential air conditioning condenser unit is typically within the range of 6-12 inches, but can be any dimension necessary to provide a manufactures recommended clearance, and that clearance dimension is also maintained between the top of the unit 20 and the inner surface of the cover panel member 140. As the panel members 110, 115, 120, 130 and 140 can be made dimensionally in practically any size, to and including 4 feet by 8 feet, sufficient clearance is easily provided to maintain adequate ventilation for practically any utility structure or mechanical device 20. Like the fastening apertures 118, fastening apertures 36 may be internally threaded, receive inserts, or appropriately for engagement by an appropriate threaded fastener 174.

Figure 8A:
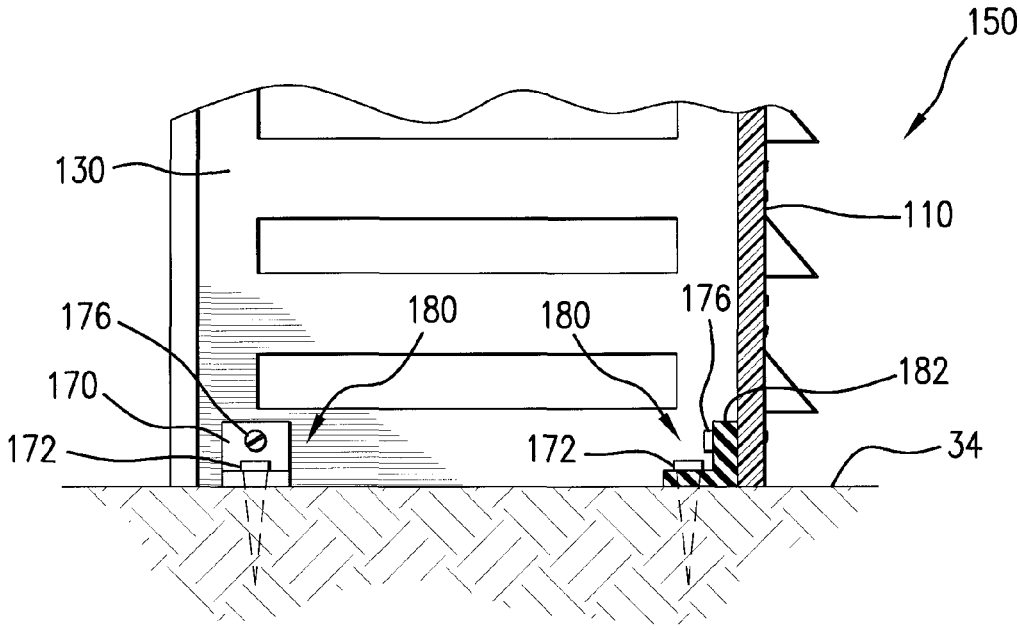
FIG. 8A is a cross-sectional view illustrating the coupling assembly of the present invention.
Figure 8B:
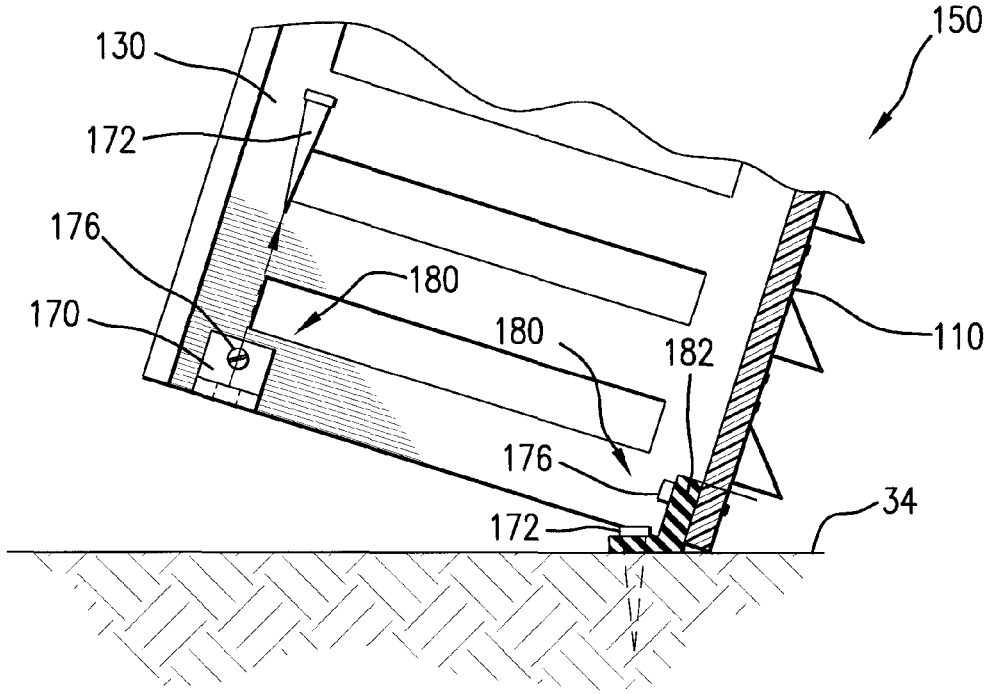
FIG. 8B is a cross-sectional view illustrating use of a coupling assembly of the present invention.

Turning now to FIGS. 8A and 8B, there is shown a coupling assembly 180 of landscape concealment structure 200 that provides for pivotal coupling with a base surface so that the housing is able to be rotatively displaced to expose the object enclosed within the space 126. Obviously, there are times when maintenance or other circumstances require access to utility structures or mechanical devices enclosed by landscape concealment structure 200. To accommodate access to the enclosed object 20, one pair of the bracket members 170 in the previously described arrangement is respectively replaced by pivotal coupling members 182 and a remaining pair of bracket members is used to secure the housing 150 against rotative displacement. Accordingly, the coupling assembly 180 includes at least one pair of bracket members 170 and at least one pair of pivotal (elastic) members 182 and their associated fasteners as will be described in following paragraphs.

The pivotal coupling members may take many forms, such as various hinged type joints. However, one simple method of forming such a pivotal coupling member is through the use of an elastic member 182, which may be preformed to have an L-shaped contour when in an unstressed condition, or simply an elastic strap which is secured to both the shell 100 and a support surface 34, 30, and which may take on an L-shaped contour when the shell 100 is resting firmly on the support surface. Although the embodiment depicted in FIGS. 8A and 8B show housing 150 secured to an earthen surface 34, it should be understood that the arrangement shown in FIG. 6 may also be modified to make use of the elastic member 182. Elastic member 182 may be formed of various polymeric materials including natural and synthetic rubber compositions.

In the arrangement shown in FIGS. 8A and 8B, one pair of bracket members 170 is secured to respective fastening apertures 118 by means of threaded fasteners 176 adjacent a rear end of the side panels 130 and 120 (only one side being shown for clarity). Elastic members 182 are similarly secured to fastening apertures 118 of the front panel 110, in this example, by threaded fasteners 176 (only one elastic member being shown for clarity). The bracket members 170 and elastic straps 182 are secured to the base surface 34 by appropriate fasteners, in this case, stake members 172. When it is desired to expose the object being concealed within the housing 150, the stake members 172 securing the brackets 170 to the base surface 34 are removed and the housing 150 then rotated toward the panel member to which the elastic straps 182 are secured. Obviously, in some applications it would be more desirable to pivot the housing toward one of the side members, instead of toward the front panel member 110. For those applications, a pair of elastic members 182 would be secured to a selected side panel member 120 or 130, as appropriate, and the bracket members 170 secured to the opposing side panel member 130 or 120.

Depending on the size of the housing 150, it may be necessary to remove the cover panel member 140 in order to access stake member 172 that may be located further in the space 126, toward the front panel member 110, as would occur when the elastic members 182 are located on one side panel member 120, 130 and the bracket members 170 are mounted on the opposing side panel member 130, 120. Where the maintenance requires complete exposure of the object 20, such as when replacement of the utility structure or mechanical device is required, the releasable coupling of the panel members 110, 115, 120, 130, and 140, utilizing dovetail shaped mortised and tenon joints, to thereby facilitate easy and complete disassembly of the landscape concealment structure 200. The artificial foliage members 160 can also be removed from the panel members, allowing for compact storage of the landscape concealment structure 200, if such is required.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims.

What is being claimed is:

1. A landscape concealment structure for obscuring a utility structure or mechanical device from view, comprising:

a front panel member having a parallelepiped contour and a plurality of ventilation openings formed therein, said front panel member including fastening structures formed integrally thereon;

a pair of side panel members each including fastening structures formed integrally thereon and being complementary to said fastening structures of said front panel member for mated coupling therebetween, each of said pair of side panel members being directly releasably lockingly coupled to said front panel member adjacent a corresponding one of opposing sides thereof by respective engagement between said fastening structures of said front panel member and said complementary fastening structures of each said side panel members to form a self-supporting shell, each of said side panel members having a parallelepiped contour with a plurality of ventilation openings formed therein, said shell defining a self-supporting structure and substantially surrounding a space containing an object to be concealed; and a cover panel member having a parallelepiped contour, said cover panel member being releasably coupled to said shell and overlaying said space containing the object to form a housing.

2. The landscape concealment structure as recited in claim 1, further comprising a plurality of artificial foliage members coupled to said housing to camouflage said housing, each of said artificial foliage members having a supporting shaft portion coupled to said housing and extending radially therefrom to support said artificial foliage member in spaced relationship from said housing, said supporting shaft portion of each of said plurality of artificial foliage members being respectively releasably engaged within bores formed in each of said front panel member, said pair of side panel members and said cover panel member.

3. The landscape concealment structure as recited in claim 1, where said ventilation openings are shielded by louvers for limiting ingress of precipitation into said ventilation openings.

4. The landscape concealment structure as recited in claim 1, further comprising a coupling assembly coupled to said shell for securing said shell to a base surface, said coupling assembly including at least one pivotal coupling member disposed in said space being surrounded for rotatively displacing at least said shell relative to the base surface about said at least one pivotal coupling member to expose the object, said at least one coupling member having a pair of opposing end portions, a first of said pair of end portions being coupled to said shell and a second of said pair of end portions being coupled to the base surface.

5. The landscape concealment structure as recited in claim 4, where said coupling assembly includes a plurality of pivotal coupling members formed by a plurality of elastic members coupled between a side of said shell facing said space being surrounded and the base surface within said space being surrounded.

6. The landscape concealment structure as recited in claim 1, where said shell further includes a rear panel member having a parallelepiped contour and fastening structures formed integrally thereon and being matingly coupled with said complementary fasting structures of said pair of side panel members.

7. The landscape concealment structure as recited in claim 1, where said fastening structures and complementary fastening structures are one of corresponding tenons and grooves of a sliding dovetail joint extending longitudinally in parallel with corresponding longitudinal sides of said front and side panel members on which said fastening structures and said complementary fastening structures are formed.

8. A landscape concealment structure for obscuring a utility structure or mechanical device from view, comprising:

a front panel member having fastening structures formed on longitudinal sides thereof, said fastening structures being integrally formed thereon;

a pair of side panel members each having fastening structures formed on longitudinal sides thereof, said fastening structures of said side panel members being integrally formed thereon and complementary to said fastening structures of said front panel member for mated coupling therebetween, each of said pair of side panel members being directly releasably lockingly coupled to said front panel member adjacent a corresponding one of opposing longitudinal sides thereof by respective longitudinal sliding engagement between said fastening structures of said front panel member and said complementary fastening structures of each said side panel members to form a shell, said shell defining a self-supporting structure and substantially surrounding an interior space containing an object to be concealed;

a cover panel member releasably coupled to said shell and overlaying said interior space to form a housing; and a plurality of artificial foliage members coupled to said housing to camouflage said housing.

9. The landscape concealment structure as recited in claim 8, where each of said front panel member, said pair of side panel members and said cover panel member has a parallelepiped contour, each with a respective plurality of ventilation openings formed therethrough.

10. The landscape concealment structure as recited in claim 9, where said ventilation openings are louvered openings oriented to limit ingress of precipitation into said ventilation openings.

11. The landscape concealment structure as recited in claim 8, where said shell further includes a rear panel member having fastening structures formed on longitudinal sides thereof and a parallelepiped contour, said fastening structures of said rear panel member being integrally formed thereon and wherein said rear panel member is releasably lockingly coupled to said pair of side panel members by mated coupling between said fastening structures of said rear panel member and said fastening structures of each of said pair of side panel members.

12. The landscape concealment structure as recited in claim 8, where said plurality of artificial foliage members are respectively releasably engaged within bores formed in each of said front panel member, said pair of side panel members and said cover panel member, each of said artificial foliage members having a supporting shaft portion releasably coupled within a respective one of said bores and extending radially therefrom to support said artificial foliage member in spaced relationship from said housing.

13. The landscape concealment structure as recited in claim 8, where said shell is coupled to a base surface and said coupling includes at least one pivotal coupling member disposed in said interior space for rotatively displacing at least said shell relative to said base surface about said at least one pivotal coupling member to expose the object, said at least one coupling member having a pair of opposing end portions, a first of said pair of end portions being coupled to said shell and a second of said pair of end portions being coupled to the base surface.

14. The landscape concealment structure as recited in claim 13, wherein said coupling of said shell to the base surface includes a plurality of pivotal coupling members formed by a plurality of elastic members coupled between a side of said shell facing said interior space and the base surface within said interior space.

15. The landscape concealment structure as recited in claim 8, where said fastening structures and complementary fastening structures are one of corresponding tenons and grooves of a sliding dovetail joint extending longitudinally in parallel with said longitudinal sides of said front and side panel members.

16. A landscape concealment structure for obscuring a utility structure or mechanical device from view, comprising:

a front panel member having a parallelepiped contour and a plurality of louvered openings formed therein and oriented to limit ingress of precipitation therein, said first panel member including fastening structures integrally formed thereon;

a pair of side panel members respectively coupled to said front panel member adjacent opposing sides thereof to form a self-supporting shell, each of said side panel members having a parallelepiped contour and a plurality of louvered openings formed therein and oriented to limit ingress of precipitation therein, each of said pair of side panel members includes fastening structures integrally formed thereon and being in correspondence with and complementary to said fastening structures of said front panel member for mated coupling therewith, said side panel members being directly releasably lockingly coupled to said front panel member by said fastening structures of said front panel member and said complementary fastening structures of said side panel members, said shell substantially surrounding an interior space containing an object to be concealed;

a cover panel member having a parallelepiped contour, said cover panel member being releasably coupled to said shell by a plurality of corresponding complementary fastening structures integrally formed respectively thereon, said cover panel member overlaying said interior space to form a housing and having a plurality of louvered openings formed therein;

a plurality of artificial foliage members each having a supporting shaft portion coupled to said housing and extending radially therefrom to respectively support said artificial foliage members in spaced relationship from said housing and thereby camouflage said housing, said supporting shaft portion of each of said plurality of artificial foliage members being respectively releasably engaged within bores formed in each of said front panel member, said pair of side panel members and said cover panel member; and a coupling assembly coupled to said shell for securing said shell to a base surface, said coupling assembly including at least one pivotal coupling member disposed in said interior space for rotatively displacing at least said shell relative to the base surface about said pivotal coupling member to expose the object, said at least one coupling member having a pair of opposing end portions, a first of said pair of end portions being coupled to said shell and a second of said pair of end portions being coupled to the base surface.

17. The landscape concealment structure as recited in claim 16, wherein said fastening structures and complementary fastening structures for joining said front panel member and side panel members are one of corresponding tenons and grooves of a sliding dovetail joint extending longitudinally in parallel with corresponding longitudinal sides of said front and side panel members on which said fastening structures and said complementary fastening structures are formed.

* * * * *